United States Patent [19]

Harach et al.

[11] Patent Number: 4,911,826

[45] Date of Patent: Mar. 27, 1990

[54] SPARGING SYSTEM FOR COLUMN FLOTATION

[75] Inventors: Peter L. Harach, Kimberley; Donald B. Waites, Marysville; Michael A. Redfearn, Kimberley, all of Canada

[73] Assignee: Cominco Ltd., Vancouver, Canada

[21] Appl. No.: 312,530

[22] Filed: Feb. 21, 1989

[30] Foreign Application Priority Data

Feb. 8, 1989 [CA] Canada ..... 590510

[51] Int. Cl.[4] ..... B03D 1/24

[52] U.S. Cl. ..... 209/170; 261/124; 261/DIG. 75

[58] Field of Search ..... 209/170, 164; 210/221.2, 704; 261/124, DIG. 75

[56] References Cited

U.S. PATENT DOCUMENTS

| | | | |
|---|---|---|---|
| 1,314,316 | 8/1919 | Flinn | 209/170 |
| 1,583,141 | 5/1926 | Greenwalt | 209/170 |
| 2,938,629 | 5/1960 | Hollingsworth | 209/170 |
| 3,339,730 | 9/1967 | Boutin | 209/170 |
| 4,212,730 | 7/1980 | Brooks | 209/170 |
| 4,624,791 | 11/1986 | Ferriss | 209/170 |

*Primary Examiner*—David L. Lacey
*Assistant Examiner*—Thomas M. Lithgow
*Attorney, Agent, or Firm*—Arne I. Fors; D. Doak Horne

[57] ABSTRACT

A system for sparging aerated water into a column for the froth flotation of minerals, and located in the lower portion of the column, consists of water and air supply headers connected to a supply of pressurized water and air, respectively. The headers comprise a number of water and air passages, each having shut off valves. A multiplicity of sparger tubes is arranged, in one or more horizontal planes, either radially towards the column center or parallel to each other from opposite sides of the column. Each sparger pipe comprises a mixing tee attached to a water passage and an air passage, and a perforated portion provided with a number of small openings. The number of openings in each pipe is determined by the cross-sectional area covered by the sparger pipe. The openings may be arranged upwardly and/or downwardly at an angle in the range of about 5° to 90° from the horizontal. The openings are preferably arranged in a single row and directed vertically downwardly, or in two parallel rows and directed radially downwardly at an angle of 5° to 75° from the horizontal. Each opening is provided with a wear-resistant material, preferably in the form of an insert and preferably made of tungsten carbide, to reduce erosion of the openings. The number of openings is chosen such that the air bubbles exit from the openings and rise in the column substantially evenly distributed over the entire cross section of the column.

11 Claims, 3 Drawing Sheets

SPARGING SYSTEM FOR COLUMN FLOTATION

This invention relates to froth flotation and, more particularly, to a sparging system for use in a flotation column.

BACKGROUND OF THE INVENTION

Flotation columns are being increasingly used in the froth flotation concentration of minerals. In column flotation, a suspension of finely divided ore, containing mineral and gangue particles, is injected together with reagents into a column, usually about one quarter of the way down from top of the column, air is injected into the lower portion of the column to form a multitude of small air bubbles, and washwater is distributed into the top of the column to wash down entrained gangue particles. The froth containing the mineral particles is recovered from the top, and gangue is removed from the bottom of the column.

The air is preferably injected in the form of aerated water that may contain reagents such as frothers. The bubbles should rise uniformly across the cross section of the column. To effect this, devices, such as spargers, injectors, aspirators, nozzles and bubble generators, may be used. The preferred air bubble size in the column is related to the size of the ore particles being treated. Generally, small uniformly-sized bubbles are required to effectively float fine mineral particles, smaller than about 150 microns. To form small bubbles of uniform size, the air and water are usually ejected from the above-named devices under a relatively high pressure such as in the range of 300–700 $kN/m^2$.

BRIEF DESCRIPTION OF PRIOR ART

The use of aerated water in a column for separating mineral particles from gangue was disclosed as early as 1907 in U.S. Pat. No. 873 586. According to U.S. Pat. No. 1 16 835 the distribution of the air bubbles was improved by distributing the aerated water through ring-shaped spargers positioned at different heights in the column. In U.S. Pat. No. 1 314 316, the inventor proposes the use of a plurality of perforated pipes arranged parallel to each other in a horizontal plane, and, to improve bubble distribution over the entire cross section of a cylindrical or rectangular column cell, he uses more than one layer of such pipes. Systems for sparging aerated water into pneumatic flotation devices using a variety of means, including perforated pipes, have been disclosed in numerous other patents (U.S. Pats. Nos. 1 367 332, 2 758 714, 2 938 629, 3 032 199, 3 371 779, 3 334 596, 3 525 437, 4 287 054, 4 394 258, 4 431 531, 4 472 271, 4 491 549, 4 592 834, 4 617 113 and 4 752 383).

A sparging system for aerated water such as disclosed in U.S. Pat. No. 1 314 316, whether used in one or more layers of pipes, provides an excellent distribution of air bubbles across a flotation column. However, this and similar sparging systems all have a major and destructive disadvantage. As stated before, relatively high pressures for the water and air and, therefore, of the aerated water, are necessary to obtain the required small air bubble size.

As a result of the use of these relatively high pressures, severe erosion of the perforated pipes occurs at the openings resulting in quick enlargement of the openings and loss in uniformity of the bubble sizes. This in turn results in lower concentrate grade and a decreased mineral recovery.

SUMMARY OF THE INVENTION

We have now found that the erosion of openings in perforated pipes of a sparging system can be substantially obviated. More specifically, we have found that erosion at the openings (orifices) in the perforated sparger pipes of a sparging system for feeding aerated water into a column for froth flotation of ores can be obviated by providing each opening in a perforated sparger pipe with a wear-resistant material. In a preferred embodiment, each opening is provided with an insert made of a wear-resistant material. Suitable materials include hard rubber, suitable carbides and suitable ceramics.

The perforated sparger pipes are part of a sparging system that consists of an air supply header, a water supply header and a multiplicity of horizontal, perforated sparger pipes arranged in one or more horizontal planes. Each pipe has a mixing tee at one end and a multiplicity of openings along its length. Each opening is provided with a wear-resistant material, preferably in the form of an insert. The mixing tee on each sparger pipe is suitably connected to the air supply header and the water supply header. Preferably, the sparger pipes are inserted through the wall of the flotation column at its lower end and are directed either radially towards the centre of the column, or from opposite sides of a centre line through the horizontal cross section of the column. The pipes may have the same or varying lengths depending on their arrangement and the configuration of the column cross section. The openings are directed either upwardly or downwardly or both upwardly and downwardly at an angle in the range of about 5° to 90° from the horizontal. The opening are preferably located in the lower half of each perforated pipe in one or two rows and are directed radially downwardly under an angle in the range of about 5° to 90° from the horizontal. The openings are more preferably arranged in two parallel rows and downwardly at an angle in the range of 5° to 75°, most preferably 45°. Depending on the location of a pipe in the column cross section, the distance between openings and the number of openings are varied to ensure even bubble distribution over the entire column cross section.

Accordingly, it is an object of the present invention to provide an air-water sparging system. It is another object to provide a system for sparging aerated water into a column for froth flotation of minerals. It is a further object to provide a sparging system for aerated water wherein erosion has been obviated. It is yet another object to provide a sparger pipe for aerated water wherein erosion has been substantially obviated.

According to the main embodiment of the invention, there is provided a sparging system for supplying aerated water to a flotation column comprising a multiplicity of sparger pipes mounted in the lower portion of said column in one or more horizontal planes, means for supplying water under pressure to said sparger pipes, and means for supplying air under pressure to said sparger pipes, said sparger pipes each having a perforated portion having a hollow core and having a number of openings spaced along its length and each opening extends from said core and terminates at the surface of the pipe, each opening having a length and each opening comprises an enlarged portion beginning at the surface of the pipe and extending at least a portion of its length toward the core, and each enlarged portion is provided with a suitable wear-resistant material over at least a portion of its length including said portion at the surface of the pipe, said suitable wear-resistant material preventing erosion of said openings by aerated water exiting through said openings.

According to a second embodiment there is provided a sparger pipe adapted to supply aerated water to a column for the froth flotation of ores including a perforated portion having a number of openings spaced along its length, each opening having a length and having an exit portion at the surface of said pipe, and each opening is provided with a suitable wear-resistant material over at least a portion of said length and including said exit portion, said suitable wear-resistant material preventing erosion of said openings.

Preferably, the openings in the sparger pipes are directed at an angle in the range of about 5° to 90° from the horizontal.

BRIEF DESCRIPTION OF THE DRAWINGS

The invention will now be described with reference to the accompanying drawings of a preferred and specific embodiment wherein like parts are indicated with like numbers and wherein.

DETAILED DESCRIPTION

The sparging system according to the present invention is use with flotation columns that can either have a cylindrical, a square, or a rectangular configuration. Generally, the sparging system for supplying aerated water to the column comprises a multiplicity of sparger pipes mounted in the lower portion of the column i one or more horizontal planes, means for supplying water under pressure to the sparger pipes and means for supplying air under pressure to the sparger pipes. Each of the sparger pipes has a perforated portion with a number of openings. The sparger pipes of the system may either be arranged radially inward towards the centre of the column or may be arranged parallel to each other from opposite sides of a centre line through the horizontal cross section of the column. The following detailed description with reference to the drawings is for a preferred system of parallel pipes arranged from opposite sides of a cylindrical column having a circular cross section.

Figure 1:
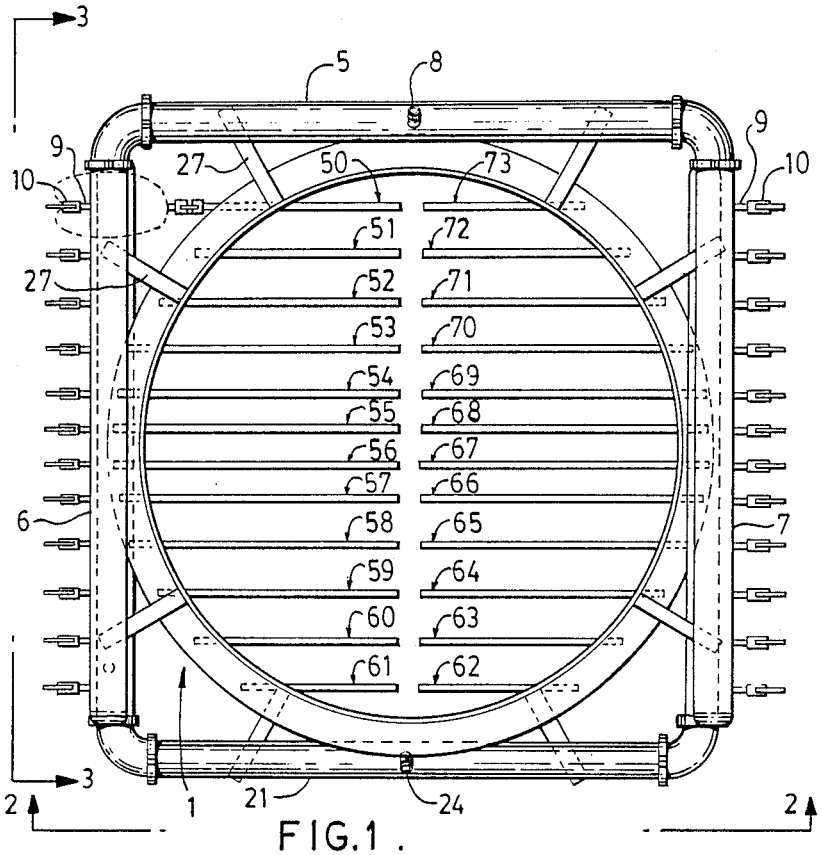
FIG. 1 is a plan view of a flotation column with a sparging system according to the invention.
Figure 2:
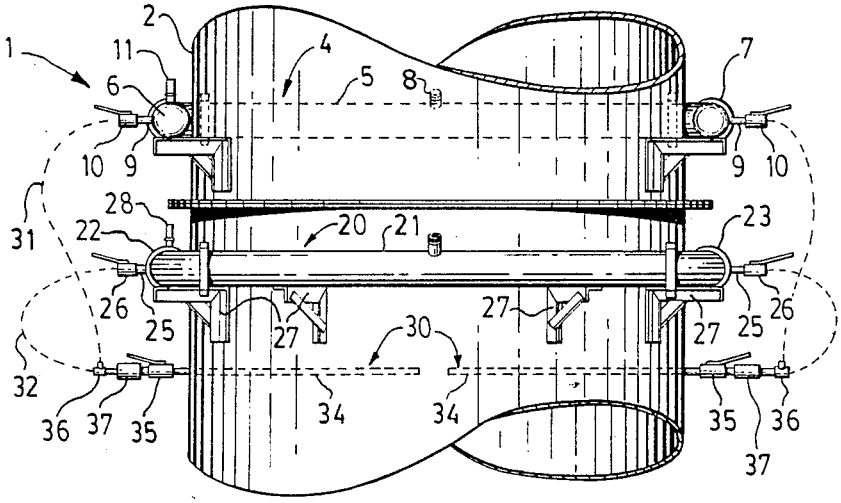
FIG. 2 is an elevation along line 2—2 of FIG. 1.
Figure 3:
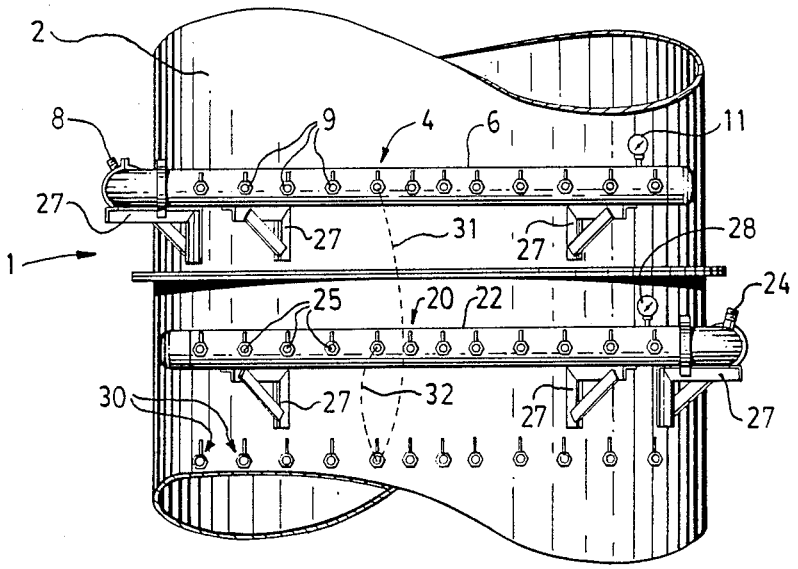
FIG. 3 is an elevation along line 3—3 of FIG. 1.

FIGS. 1, 2 and 3, show the lower portion, generally indicated at 1, of a flotation column where the sparging system is located. The column has a cylindrical body 2 closed at its lower extremity by a conical bottom (not shown).

Partly surrounding lower portion 1 is a U-shaped water manifold generally indicated with 4 consisting of a water supply pipe 5 and two parallel water manifold pipes 6 and 7 connected to water supply pipe 5 at right angles. Water supply pipe 5 is provided with a means 8 or connection to a supply of water (not shown). Each water manifold pipe 6 and 7 is provided with an equal number of water passages 9 each having adjustable shut off means 10 that are connected to sparger pipes, to be described. Sparger pipes are generally indicated at 30 (FIG. 2). Water pressure in water manifold 4 is indicated by pressure gauge 11. Also partly surrounding lower portion 1 is a U-shaped air manifold generally indicated with 20 consisting of an air supply pipe 21 and two air manifold pipes 22 and 23 connected to air supply pipe 21 at right angles. Air supply pipe 21 is provided with a means 24 for connection to a supply of pressurized air (not shown), the air pressure being indicated on gauge 28. Each air manifold pipe 22 and 23 is provided with an equal number of air passages 25 each having adjustable shut off means 26 that are connected to sparger pipes 30, to be described. Each air passage 25 is spaced from a corresponding water passage 9 in a vertical direction. If desired, each water passage 9 and each air passage 25 may be provided with a suitable orifice (not shown) that is sized such that in case a sparger pipe fails such failed pipe does not take all the air or water flow.

The U-shaped air manifold 20 partly surrounds column lower portion 1 oppositely from U-shaped water manifold 4 so that the air supply pipe 21 is opposite the water supply pipe 5 and air manifold pipes 22 and 23 are parallel to water manifold pipes 6 and 7. Both manifolds 4 and 20 are supported in vertically spaced relation above the conical bottom of the column by supports 27. The number of water passages 9 with adjustable shut off means 10 is equal to the number of air passages 25 with adjustable shut off means 26, and both numbers are equal to the number of sparger pipes 30. The number of sparger pipes may vary and depends on the size of the column, which also dictates the number of water and air passages and, hence, the size of the water and air manifolds. The use of relatively large size manifolds ensures a substantially even split of air and water to each sparger pipe.

It is noted that this arrangement of manifolds is easily adapted for a flotation column with a rectangular or square cross section.

Sparger pipes 30 are mounted in one or more horizontal planes in the lower portion 1 of the flotation column at some distance above the bottom and, preferably, below water manifold 4 and air manifold 20. An arrangement in one horizontal plane, as shown, is usually adequate. The sparger pipes re preferably arranged parallel to each other and may be equally spaced from each other, or the spacing may vary, as long as a substantially even distribution of aerated water over the entire cross section of the column is realized. The sparger pipes 30 pass through the wall of cylindrical portion 2 in a direction perpendicular to manifold pipes 6, 7, 22 and 23, and are mounted in pairs, one pipe of a pair being opposite add in line with the other pipe and terminating close to the other at the horizontal centre line of the column parallel to the manifold pipes. A sparger pipe is preferably mounted substantially vertically below a water passage 9 and corresponding air passage 25. Each water passage 9 and corresponding air passage 25 is connected to the sparger pipe directly below the corresponding passages by means of, preferably, flexible hoses 31 and 32, respectively (one of which is shown as indicated with interrupted lines in FIGS. 2 and 3).

Figure 4:
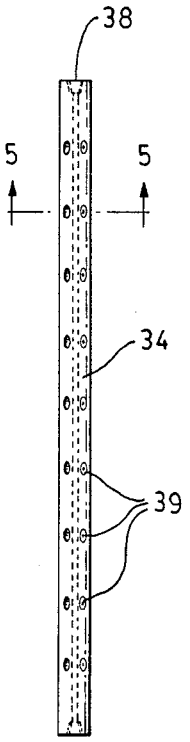
FIG. 4 is a bottom view of the perforated portion of a sparger pipe for a sparging system.

A sparger pipe 30, consists of a perforated portion 34 inside the column and a mixing tee 36 outside the column. Suitably connected to mixing tee 36 are flexible hoses 31 and 32 for admitting water and air, respectively, to the sparger pipe. The sparger pipe 30 can be inserted into the column by sliding it through a coupling 37, such as, for example, a friction coupling and a shut off means 35 attached to lower portion of the flotation column. The perforated portion 34 of sparger pipe 30 is closed at its extremity inside the column with a removable pipe plug 38 (FIG. 4). The perforated portion 34 is provided with a number of openings 39 that may be directed either upwardly or downwardly or both upwardly and downwardly, and are spaced along its length. Downwardly directed openings are preferred, as better air distribution and a smaller turbulent region are obtained. The openings are directed at an angle in the range of about 5° to 90° from the horizontal. Preferably, the openings are directed radially.

Figure 5:
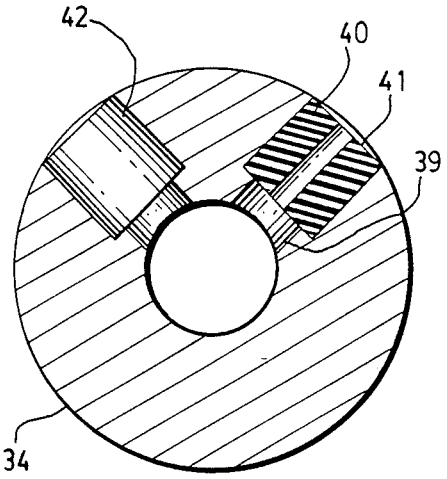
FIG. 5 is an enlarged section along line 5—5 of FIG. 4.

In preferred embodiments, the openings are located in the lower half o the pipe, are substantially equally spaced, and are directed radially downwardly at angles in the range of from 5° to 90° from the horizontal. The angles of the openings may vary or may be the same. At angles below about 5° the jets of aerated water from a pipe may hit an adjacent pipe and cause erosion. Either one row of openings 39, each opening preferably directed substantially vertically downwardly, that is at an angle of about 90°, may be used (not shown), or the openings are, most preferably, arranged in two adjacent rows as shown in FIG. 4. The openings of the two rows are directed radially downwardly at an angle in the range of about 5° to 75° from the horizontal, preferably at an angle of 45°, as shown in FIG. 5. The openings of the two rows may be arranged in pairs, that is, the openings of a pair being on the same cross section of the pipe. This arrangement is suitable for sparger pipes located in the centre portion of the column cell. For the sparger pipes located closer to the wall(s) of the column cell, openings in the row of openings directed towards and close to the wall(s) are eliminated to prevent erosion of the wall(s). Thus, the number of openings in one row may be lower than that in the other row of a pipe, depending on the proximity of the pipe to a column wall. Similarly, for openings arranged in one row, some are eliminated where a pipe is in proximity to a column wall.

The longitudinal spacing of openings 39 along the length of a pipe 30 varies from pipe to pipe so that a substantially even distribution of air bubbles exiting from the openings is obtained across the entire column cross section. Generally, the longitudinal spacing between openings along the perforated portion of the pipes increases towards the centre of the column.

Each opening 39 is provided with a suitable wear-resistant material over at least a portion of its length including its exit portion 41 at the surface of the pipe. The wear-resistant material prevents erosion of the opening by the aerated water passing through the sparger pipe at high pressure and exiting through the openings as jets. Suitable wear-resistant materials are, for example hard rubber, certain ceramics, such as silicon carbide, and carbides, such as tungsten carbide. The wear-resistant material may be applied by one of a number of suitable methods known in the art, for example, by bonding, spray coating, flame spraying, or plasma coating (temporarily plugging the openings, if necessary). Preferably, the wear-resistant material is in the form of an insert 40 having a hollow, open cylindrical body and fittingly inserted in an enlarged portion 42 of opening 39, such as, for example, by threading, crimp fitting, crimping the pipe surface, or bonding.

The length of the perforated portion 34 of a sparger pipe 30 depends on the configuration of the flotation column. The sparger pipes in a column of square or rectangular configuration have generally the same lengths, while those in a cylindrical column have varying lengths that are adapted to its circular cross section and to ensure even bubble distribution over the entire column cross section.

Figure 6:
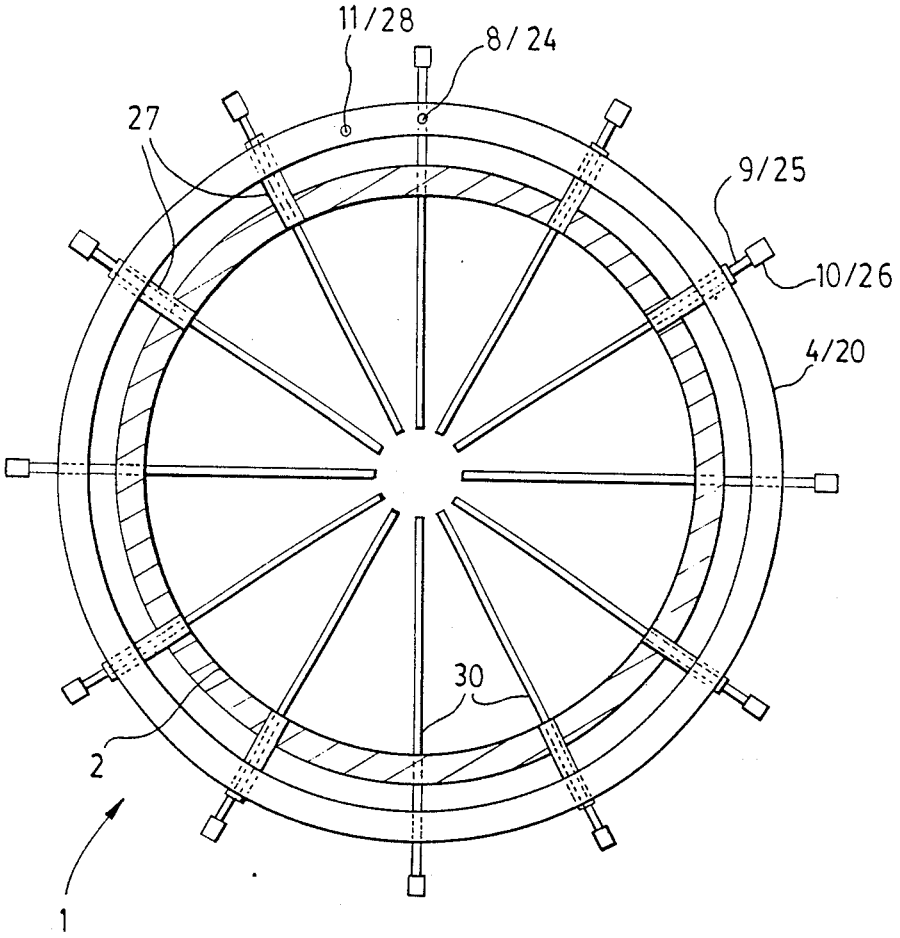
FIG. 6 is a schematic plan view of an alternative embodiment of the sparging system according to the invention.

An alternative, similar sparging system is shown schematically in the plan view of FIG. 6. The alternative system is preferably used for a cylindrical column and is arranged at the lower portion 1 o the cylindrical body 2 of the column. Surrounding lower portion 1 are two circular (super imposed) manifolds, one for water and one for air, generally indicated with 4 for the water manifold and with 20 for the air manifold. The respective manifolds are connected at 8 and 24 to a supply (not shown) of water underpressure and pressurized air, respectively, with pressures indicated on gauges at 11 and 28, respectively. The manifolds are positioned above each other (super imposed), and are provided with an equal number of water passages 9 and air passages 25, respectively, each passage having a shut off means 10 and 26, respectively, and connected to the mixing tees 36 of sparger pipes 30 with connecting hoses 31 and 32 (not shown). The manifolds are supported around the column by supports 27. The water and air passages on the respective manifolds are spaced at equal distances, and their numbers are equal to the number of sparger pipes.

The sparger pipes 30 are as described herein above, and are directed radially inward through the wall of the column towards the centre of the column. The pipes are arranged at substantially equal radial angles. The sparger pipes may have substantially the same length, and terminating some distance short from the vertical centre line of the column. The pipes may also have varying lengths. For example, for large diameter columns, some pipes may extend close to the centre of t he column, and shorter pipes (not shown) may be disposed between the longer pipes, so that longer and shorter pipes alternate, to ensure bubble generation substantially evenly across the column cross section. The arrangement of openings 39 in the sparger pipes is similar to that described with reference to FIGS. 1–5, and is appropriate and adjusted such that a substantially even distribution of air bubbles across the cross section of the column is obtained. Because of a higher density of sparger pipes at the centre of the column, some openings are deleted as necessary. To avoid erosion of the column wall, openings that would direct a jet of aerated water onto the wall are deleted.

In the operation of the sparging system in a flotation column, water and air are admitted under pressure to water manifold 4 and air manifold 20, respectively, from their respective sources. The water and air pressures are regulated at their sources and manifold pressures are indicated on gauges 11 and 28, respectively. The water passes through the water supply pipe 5, water manifold pipes 6 and 7, water passages 9 with shut off means 10 and hoses 31 to the mixing tees 36 of sparger pipes 30. The air passes through the air supply pipe 21, air manifold pipes 22 and 23, air passages 25 with shut off means 26 and hoses 32 to the mixing tees 36 of sparger pipes 30. The water and air thoroughly mix in mixing tees 36, and aerated water passes into the perforated portions 34 of sparger pipes 30. The aerated water exits as jets of air bubbles from openings 39 into the bottom portion 1 of the flotation column. The air bubbles rise in the column substantially evenly distributed over the entire cross section of the column. The operation of the sparging system according to the alternative embodiment shown in FIG. 6 is similar.

The water pressure and air pressure indicated on gauges 11 and 28 are regulated in a range of about 300 to 700 KN/m$^2$ (about 40 to 100 psi) dependent on the particle sizes of the ore being treated. Very fine particles require very small air bubbles, coarser particles require larger air bubbles for effective flotation of the mineral to be recovered. A decrease in the volume of water and, conversely, an increase in the volume of air cause the formation of larger air bubbles. The volume of water and air are normally regulated at their respective source, but could also be regulated by adjusting the adjustable shut off means 10 and 26, respectively.

The invention will now be illustrated by the following non-limitative example.

EXAMPLE

Using the sparging system as illustrated in the accompanying drawings of FIGS. 1 through 5, a cylindrical flotation column with a diameter of 2.4 m and a height of 11.6 m was operated for the concentration of zinc sulfide from a lead-zinc sulfide ore. The air and water manifolds were made of 0.15 m diameter pipe. The perforated pipes were mounted 1.1 m above the conical bottom and 2.3 m above the outlet in the apex of the conical bottom.

In the bottom portion of the column 24 sparger pipes ere mounted, numbered from 50 through 73, as shown in FIG. 1. The sparger pipes were made of stainless steel pipe with an outside diameter of 21.34 mm and an inside diameter of 6.35 mm. Openings with a diameter of 3.175 mm, each provided with a tungsten carbide insert in a portion enlarged to 4.8 mm, were provided in two rows in the bottom half of each pipe. The openings were provided in varying numbers and at varying spacings depending on the location of each pipe in the column cross section and the required length of the pipe, such that an array of openings was provided in the column cross section with a density equal to approximately 125 openings per m$^2$ of column cross section. The openings in the pipes were directed downwardly at angles of 45° to the right and/or left of the vertical. Each enlarged opening in the sparger pipes had a cylindrical tungsten carbide insert having a length and a diameter of 4.8 mm and a central cyclindrical passage with a diameter of 0.9 mm.

In FIG. 1 the sparger pipes are numbered from 50 to 73 and for each pipe, the length, distance between opening centres along the pipe and the number of openings in the right bottom quadrant and the left bottom quadrant (as facing a pipe from its inlet end) are given in Table I. The distance of the first openings in the perforated portion of a pipe as measured from both its ends was 51 mm.

TABLE I

| | | Sparger Pipe | | |
|---|---|---|---|---|
| Pipe No. | Length in mm | Opening Spacing in mm | Openings in right side No. | Openings in left side No. |
| 50, 62 | 1130 | 38 | 14 | 10 |
| 51, 63 | 1359 | 57 | 13 | 11 |

TABLE I-continued

| | | Sparger Pipe | | |
|---|---|---|---|---|
| Pipe No. | Length in mm | Opening Spacing in mm | Openings in right side No. | Openings in left side No. |
| 52, 64 | 1486 | 64 | 13 | 11 |
| 53, 54, 57, 58 65, 66, 69, 70 | 1613 | 79 | 12 | 12 |
| 55, 56, 67, 68 | 1638 | 79 | 13 | 13 |
| 59, 71 | 1486 | 64 | 11 | 13 |
| 60, 72 | 1359 | 57 | 11 | 13 |
| 61, 73 | 1130 | 38 | 10 | 14 |

When the system was operated with an air flow of 20 to 80 L/s (pressures 300 to 600 kN/m$^2$) and a water flow of 0.5 to 1.5 L/s (pressures 300 to 600 kN/m$^2$), air bubbles with a diameter of 1 mm were evenly distributed across the entire column cross section. No erosion of the openings in the sparger pipes or of the column wall was observed.

We claim:

1. A sparging apparatus comprising a flotation column, a multiplicity of sparger pipes mounted in the lower portion of said flotation column in one or more horizontal planes, means for supplying water under pressure to said sparger pipes, and means for supplying air under pressure to said sparger pipes, said sparger pipes each having a perforated portion having a hollow core and a number of openings spaced along its length, each opening has a length which extends from said core and terminates at the surface of the pipe and each opening comprises an enlarged portion beginning at said surface of the pipe and extending at least a portion of its length toward said core, and each enlarged portion being provided with an insert having a hollow, open cylindrical body fittingly inserted in said enlarged portion of said opening, said insert being made of wear-resistant material for preventing erosion of said openings by aerated water exiting through said openings.

2. A sparging apparatus as claimed in claim 1, wherein said sparger pipes each has a mixing tee connected to said means for supplying water and to said means for supplying air for forming aerated water therein.

3. A sparging apparatus as claimed in claim 1, wherein said openings are spaced along the length of said perforated portion and are directed at an angle in the range of about 5° to 90° from the horizontal.

4. A sparging apparatus as claimed in claim 1, wherein said openings are arranged in the lower half of each of said pipes and are directed radially downwardly.

5. A sparging apparatus as claimed in claim 1, wherein said openings are substantially equally spaced and are arranged in a single row and are directed substantially vertically downwardly.

6. A sparging apparatus as claimed in claim 1, wherein said openings are substantially equally spaced in two adjacent rows and the openings in said rows are directed radially downwardly at angle in the range of about 5° to 75° from the horizontal.

7. A sparging apparatus as claimed in claim 1, wherein said sparger pipes have a mixing tee for forming said aerated water, and wherein said openings are substantially equally spaced in two adjacent rows and the openings in said rows are directed radially downwardly at an angle of about 45° from the horizontal.

8. A sparging apparatus as claimed in claim 1, wherein said sparger pipes and said openings in the perforated portion thereof are arranged such that aerated water exiting from said openings forms a multitude of air bubbles distributed substantially evenly across the entire cross section of said column.

9. A sparging apparatus as claimed in claim 1, wherein said means for supplying water and said means for supplying air to said sparging pipes each comprises a manifold, each of said water and air manifolds is connected to a source of water and air, respectively, and said manifolds each has an equal number of passages having adjustable shut off means for passing water and air under pressure, respectively, from said manifolds to each of said sparger pipes.

10. A sparging apparatus as claimed in claim 1, wherein said wear-resistant material is chosen from hard rubber, carbides and ceramics.

11. A sparging apparatus as claimed in claim 1, wherein said wear-resistant material is tungsten carbide.

* * * * *